US010070677B2

(12) United States Patent
Durham et al.

(10) Patent No.: US 10,070,677 B2
(45) Date of Patent: Sep. 11, 2018

(54) ATTACHMENT SYSTEM FOR FRONTAL HELMET EXTENSION TO A HELMET

(75) Inventors: David Leroy Durham, San Clemente, CA (US); Gabriel Pablo Prats, Lake Forest, CA (US)

(73) Assignee: Fox Head, Inc., Irvine, CA (US)

( * ) Notice: Subject to any disclaimer, the term of this patent is extended or adjusted under 35 U.S.C. 154(b) by 815 days.

(21) Appl. No.: 13/877,426

(22) PCT Filed: Oct. 4, 2011

(86) PCT No.: PCT/US2011/054824
§ 371 (c)(1),
(2), (4) Date: Jul. 19, 2013

(87) PCT Pub. No.: WO2012/047936
PCT Pub. Date: Apr. 12, 2012

(65) Prior Publication Data

US 2013/0283508 A1 Oct. 31, 2013

Related U.S. Application Data

(60) Provisional application No. 61/390,111, filed on Oct. 5, 2010.

(51) Int. Cl.
*A42B 3/04* (2006.01)
*A42B 3/22* (2006.01)

(52) U.S. Cl.
CPC ..... *A42B 3/221* (2013.01); *A42B 3/04* (2013.01); *A42B 3/0406* (2013.01); *A42B 3/227* (2013.01)

(58) Field of Classification Search
CPC ..... A42B 3/22; A42B 3/221; A42B 3/222; A42B 3/223; A42B 3/227; A42B 1/062;
(Continued)

(56) References Cited

U.S. PATENT DOCUMENTS 1,507,216 A * 9/1924 Stockton ..... A41F 1/00 24/595.1
3,237,203 A * 3/1966 Nielsen ..... A42B 3/225 2/10

(Continued)

FOREIGN PATENT DOCUMENTS

DE 102006020134 B3 * 2/2008 ..... A24B 3/04
WO WO-2012/047936 A2 4/2012

OTHER PUBLICATIONS

PCT International Search Report and PCT Written Opinion dated Feb. 27, 2012 for International PCT Application No. PCT/US11/54824 filed Oct. 4, 2011.

*Primary Examiner* — Anna Kinsaul
(74) *Attorney, Agent, or Firm* — Mintz Levin Cohn Ferris Glovsky and Popeo, P.C.

(57) ABSTRACT

An attachment system for securing a frontal helmet extension to protective headgear, the attachment system including one or more magnetic elements disposed on the helmet and/or frontal helmet extension and one or more complementary elements disposed on the helmet and/or frontal helmet extension and adapted to engage the magnetic elements. The magnetic elements and complementary elements are configured to detachably couple the frontal helmet extension to the helmet in a position wherein the frontal helmet extension extends forward from the helmet. The magnetic properties of the magnetic elements are adapted to magnetically attract the complementary elements so that the frontal helmet extension is effectively secured to the helmet during ordinary use of the helmet while allowing release of the frontal helmet extension from the helmet upon impact.

19 Claims, 9 Drawing Sheets

(58) Field of Classification Search
CPC ..... A42B 1/064; Y10S 24/45; Y10S 24/46; Y10T 24/32
USPC ..... 2/244, 195.1, 195.2, 195.7, 13, 12, 10, 2/15, 425, 6.7, 6.6, 6.3, 6.2
See application file for complete search history.

(56) References Cited

U.S. PATENT DOCUMENTS

| | | | | |
|---|---|---|---|---|
| 3,806,951 | A | 4/1974 | Halteman | |
| 4,067,065 | A | 1/1978 | Slosek | |
| 4,097,930 | A | 7/1978 | Bay | |
| 4,195,328 | A | 3/1980 | Harris, Jr. | |
| 4,333,180 | A | 6/1982 | Bay | |
| 4,519,099 | A | 5/1985 | Kamiya et al. | |
| 4,575,875 | A | 3/1986 | Dawson et al. | |
| 4,700,411 | A | 10/1987 | Kawasaki et al. | |
| 5,093,937 | A | 3/1992 | Kamata | |
| D327,752 | S | 7/1992 | Lee | |
| 5,157,794 | A | 10/1992 | Kamata | |
| 5,253,364 | A | 10/1993 | Robinson | |
| 5,333,328 | A | 8/1994 | Roberts | |
| 5,517,698 | A | 5/1996 | Nault et al. | |
| 5,621,923 | A | 4/1997 | Tapocik | |
| 5,675,843 | A | 10/1997 | Grim et al. | |
| 6,009,555 | A | 1/2000 | Siprut | |
| 6,009,561 | A | 1/2000 | Bullock et al. | |
| 6,009,562 | A | 1/2000 | Bullock et al. | |
| 6,170,084 | B1 * | 1/2001 | Gordon | A42B 3/227 2/12 |
| 6,687,909 | B1 | 2/2004 | Witkoff | |
| 7,546,645 | B2 | 6/2009 | Goodhand et al. | |
| 7,735,158 | B2 | 6/2010 | Tsurumi | |
| 7,987,525 | B2 | 8/2011 | Summers et al. | |
| D745,224 | S | 12/2015 | Wako | |
| 9,433,253 | B2 | 9/2016 | McKinney | |
| 9,591,885 | B2 | 3/2017 | Cheng | |
| 2005/0102802 | A1 * | 5/2005 | Sitbon | A41F 1/002 24/303 |
| 2006/0133068 | A1 | 6/2006 | Sherring | |
| 2006/0218703 | A1 | 10/2006 | Prendergast et al. | |
| 2007/0028361 | A1 | 2/2007 | Ashy | |
| 2007/0124898 | A1 * | 6/2007 | Clark | A44C 17/0216 24/303 |
| 2009/0000015 | A1 * | 1/2009 | Ahn | A42B 3/227 2/422 |
| 2009/0083900 | A1 | 4/2009 | Wallace | |
| 2009/0128938 | A1 | 5/2009 | Carnes | |
| 2011/0088141 | A1 | 4/2011 | Davis | |
| 2012/0284905 | A1 | 11/2012 | Kim | |
| 2014/0366253 | A1 * | 12/2014 | Gotti | A42B 3/222 2/424 |
| 2015/0135416 | A1 | 5/2015 | Hendl | |
| 2015/0173444 | A1 | 6/2015 | O'Dell | |
| 2015/0250252 | A1 | 9/2015 | Wako | |

* cited by examiner

ATTACHMENT SYSTEM FOR FRONTAL HELMET EXTENSION TO A HELMET

RELATED APPLICATIONS

This application claims priority to and the benefit of U.S. provisional patent application No. 61/390,111, filed on Oct. 5, 2010, entitled ATTACHMENT SYSTEM FOR VISOR TO A MOTORCYCLE HELMET, the content of which is hereby incorporated by reference as if recited in full herein for all purposes.

BACKGROUND

The inventive subject matter disclosed herein relates to an attachment system for a visor to a protective helmet, such as helmets used in motocross, other motorsports or protective helmets such as being used in downhill bicycling sports.

Protective helmets are frequently used for recreational and vocational activities and sports. For example, protective helmets are used as head protection in motorsports, by jockeys in horse racing, in American football, ice hockey games, cricket games, and during rock climbing. Protective helmets are also used when performing dangerous work activities, such as hard hats used in construction work, during mining activities, and by police agents. Protective helmets are often required to be worn in transportation, for example motorcycle helmets and bicycle helmets.

Typical helmet construction consists of a shell having a generally dome-shape structure which covers most of the user's head and having a view area or opening at the front. Motorcycle helmets in particular often have flip-down face screens for rain and wind protection, and they may also have projecting visors to protect the eyes from glare.

The conventional motocross and off-road helmet has elongated chin and visor portions, a chin bar, and partially open face to give the rider extra protection while wearing goggles and to allow the unhindered flow of air during the physical exertion of this type of riding. The visor is to allow the rider to dip his head and provide further protection from flying debris during off-road riding. It will also keep the sun out of the eyes of the rider during jumps.

A visor is typically attached to the helmet by a coupling mechanism, for example, the visor may be attached to the helmet with mechanical fastener such as snaps, straps, or screws. Some of the prior art systems attach the visor to the helmet by interactions between the vents of the helmet and structural elements of the visor. For example, US 2009/0083900 describes a visor that can be affixed to a football helmet and allows an open view the helmet wearer's eyes. The visor attaches to the helmet by curving or snapping around reinforcement wires of the facemask of the helmet. Another example, U.S. Pat. No. 6,170,084, describes a visor that attaches to the helmet via a cantilever mechanism, such as a fin, that clicks into a mouthport of the helmet.

The typical visor attachment systems, however, do not allow the visor to detachably break away from the helmet upon impact without structural damage to the helmet and/or visor, nor do the prior art system allow for easy replacement of the visor in case the visor is broken or a different style is desired. Furthermore, the typical visor attachment systems do not allow the visor to be adjusted on the helmet in an upward or downward direction with an adjustment mechanism that is both reliable and user-friendly.

Accordingly there is a need for a protective helmet that provides an improved attachment system for coupling a visor to a helmet and allowing release of the visor upon impact. Additionally, there is a need for improved adjustment mechanisms for repositioning a visor on a helmet.

SUMMARY

The inventive subject matter offers a solution for these problems by providing an attachment system with the following qualities, alone or in combination.

The inventive subject matter is directed to an attachment system for securing a frontal helmet extension to a helmet, the attachment system including one or more magnetic elements disposed on the helmet and/or frontal helmet extension, and one or more complementary elements disposed on the helmet and/or frontal helmet extension and adapted to magnetically engage the one or more magnetic elements. The magnetic elements and complementary elements are configured to detachably couple the frontal helmet extension to the helmet in a position wherein the frontal helmet extension extends forward from the helmet. The magnetic properties of the magnetic elements are adapted to magnetically attract the complementary elements so that the frontal helmet extension is effectively secured to the helmet during ordinary use of the helmet while allowing release of the frontal helmet extension from the helmet upon impact of the frontal helmet extension.

In the foregoing embodiment, the frontal helmet extension may include a visor. In the foregoing embodiment, magnetic elements may include a permanent magnetic material and the complementary element may include a ferrous material. In some embodiments, the magnetic elements may include a magnetic strip located in a helmet/visor contact area. In the foregoing embodiment, the magnetic elements may be integrated in the helmet and exposed at an outer surface of the helmet, and the complementary elements may be exposed on an inner surface of the visor.

In some embodiments, the system may further include an adjustment mechanism for vertically adjusting the position of the visor by pivoting the visor. In the foregoing embodiment, the visor may pivot along the sides of the helmet and the adjustment mechanism holds the visor in the repositioned location. In the foregoing embodiment, the adjustment mechanism comprises complementary elements provided at an attachment point along a midline of the visor. In the foregoing embodiment, the adjustment mechanism may allow for repositioning of the visor with incremental adjustments in an upward or downward direction of the visor along the helmet. In the foregoing embodiment, the adjustment mechanism may include complementary elements that have one or more ridges that are contoured to complement the magnetic elements, that allow to reposition the visor incrementally, and that allow incremental repositioning of the visor on the helmet and that assist in holding the visor in the vertically adjusted position. In the foregoing embodiment, the adjustment mechanism may include an insert at an inner surface of the visor having two or more indents complementary to the magnetic elements and the indents securing the magnetic elements in a vertical direction so that the visor is held in the desired position. In some embodiments, the ridges may include a metal.

In another possible embodiment, the protective headgear may include an outer shell, a visor having an inner surface that is shaped to complement a portion of the outer shell, and an attachment system for detachably coupling the visor to the outer shell. The attachment system may include one or more magnetic elements disposed on the outer shell, and one or more complementary elements disposed on the inner surface of the visor at locations corresponding to the locations of the magnetic elements. The magnetic properties of the magnetic elements are adapted to magnetically attract the complementary elements and hold the visor in a desired position on the outer shell. The visor is kept in place during ordinary use of the headgear, and the visor is released from the headgear upon impact of the visor. In the foregoing embodiment, at least two magnetic elements may be mounted at generally opposite sides of the headgear and at least two complementary elements may be mounted at corresponding locations on the visor. In the foregoing embodiment, at least one magnetic element may be mounted at an upper area along a midline of the headgear and a complementary element may be mounted at a corresponding location along a midline of the visor. In the foregoing embodiment, the visor may extend from the headgear in a plane that is generally parallel to a horizontal plane of the headgear or may be allowed to pivot around the sides of the headgear at an angle relative to a horizontal plane. In another possible embodiment, the headgear further includes an adjustment mechanism having one or more complementary elements on the visor that are shaped to complement the magnetic elements and that allow for a vertical adjustment of the visor along the outer shell. In some embodiments, the adjustment mechanism allows for incremental adjustments of the visor in a vertical direction. In other embodiments, the complementary elements may have one or more ridges that are contoured to interact with the magnetic elements and that allow repositioning and holding the visor in a vertical direction.

In another possible embodiment, the inventive subject matter is directed to a method for making protective headgear by providing an outer shell, providing a frontal helmet extension with an inner surface that is shaped to complement a portion of the outer shell, and providing the shell and frontal helmet extension with an attachment system for detachably coupling the frontal helmet extension to the outer shell. The attachment system is formed by mounting one or more magnetic elements on the outer shell and one or more complementary elements on the inner surface of the frontal helmet extension at locations corresponding to the locations of the magnetic elements. The magnetic properties of the magnetic elements are adapted to magnetically attract the complementary elements so that the magnetic elements hold the frontal helmet extension in a desired position on the outer shell. The frontal helmet extension remains in place during ordinary use of the headgear, and the frontal helmet extension releases from the headgear upon impact of the frontal helmet extension.

The foregoing is not intended to be an exhaustive list of embodiments and features of the inventive subject matter. Persons skilled in the art are capable of appreciating other embodiments and features from the following detailed description in conjunction with the drawings

BRIEF DESCRIPTION OF THE DRAWINGS

The following figures show embodiments according to the inventive subject matter, unless noted as showing prior art.

DETAILED DESCRIPTION

Figure 1:
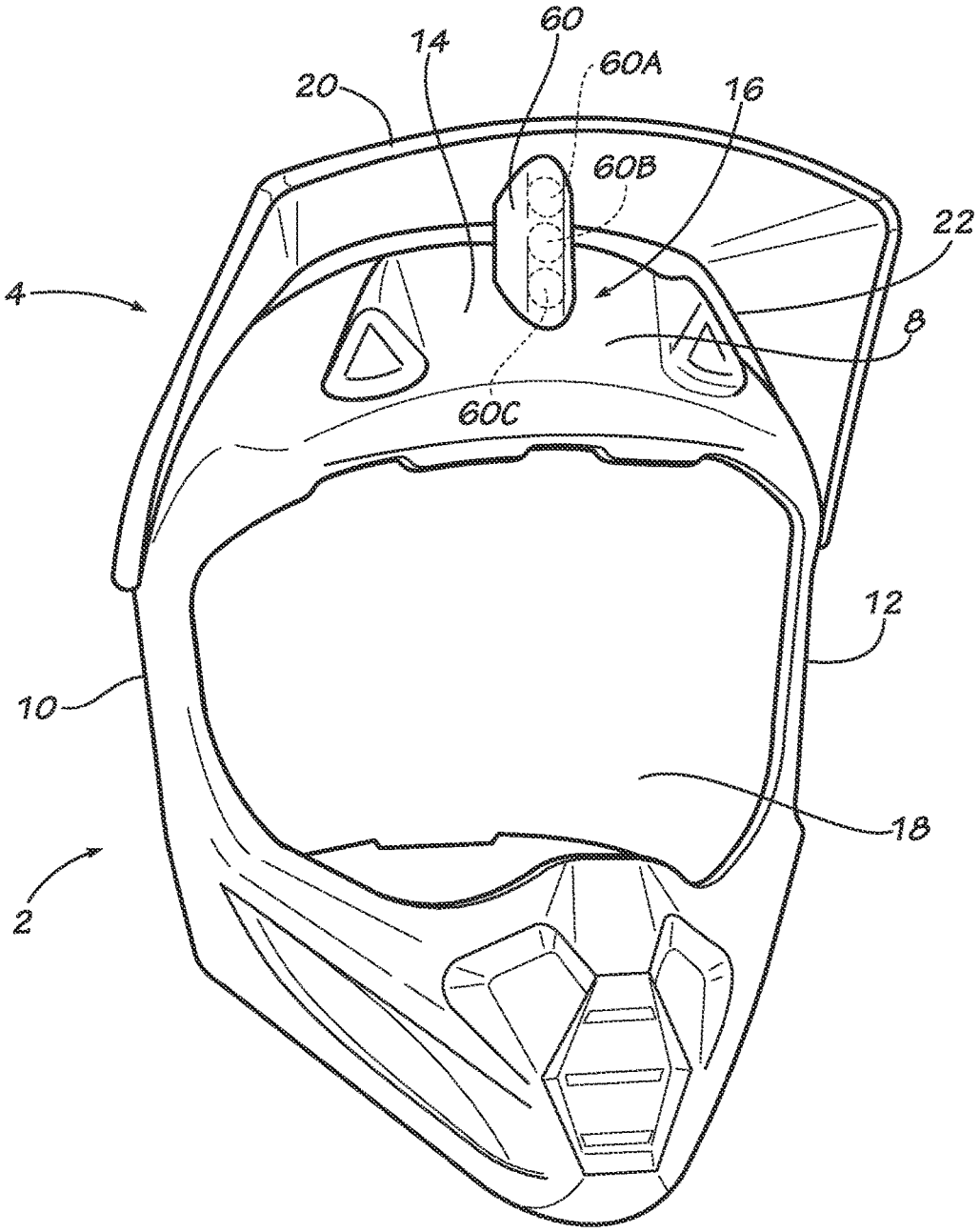
FIG. 1 is a front perspective view of a motocross helmet having a visor attached thereto.

Representative embodiments according to the inventive subject matter are shown in FIGS. 1-12, wherein the same or generally similar features share common reference numerals.

The inventive subject matter is directed to a detachable frontal helmet extension for an item of protective headgear, such as visors or faceguards used on helmets. Examples include visors as used on helmets for off-road sports, such as motocross helmets or downhill bicycling helmets, or faceguards as used on football, hockey, and baseball helmets.

The visor attaches to a front portion of the helmet, and is generally centered along a midline of the helmet. As used herein, the visor is a distinct structure that couples to the helmet and that extends from the front of the helmet to create a shade or shield to help protect the eyes and face of a wearer from objects and sun or light glare. The detachable visor system includes an attachment system that includes magnetic elements and complementary elements that are magnetically attracted to the magnetic elements, e.g., another magnetic or a ferromagnetic material, such as iron or iron alloys. The strength of the magnetic elements is adapted to balance securely coupling the visor to the helmet during ordinary use of the helmet with the ability to release the visor from the helmet upon impact of the visor with a surface, such as the ground or other hard surface. One or more of the magnetic elements may be disposed along a midline of the helmet or in a generally central area of the visor and helmet. In some embodiments, the attachment system may include a position adjustment mechanism having spaced ridges with integral magnetic elements, allowing for incremental adjustments based on ridge spacing.

FIG. 1 shows a motocross helmet 2 and a visor 4 coupled to helmet 2. Visor 4 has an inner surface 6 that is dimensioned and shaped to complement an upper front surface 8 of helmet 2. Visor 4 attaches to both sides 10, 12 of helmet 2 at generally opposite locations. Visor 4 also attaches to the helmet at a central location 14 at the front 16 of helmet 2. When visor 4 is attached to helmet 2, visor 4 projects from helmet 2 in an upper front area 16 of helmet 2 above a front view opening 18 of helmet 2. One end of visor 4 includes a projecting end 20 that extends from the front 16 of helmet 2. The other end of visor 4 includes a coupling end 22 that is arched or contoured to complement front upper surface 8 of helmet 2 at a location above view opening 18 of helmet 2.

Figure 3:
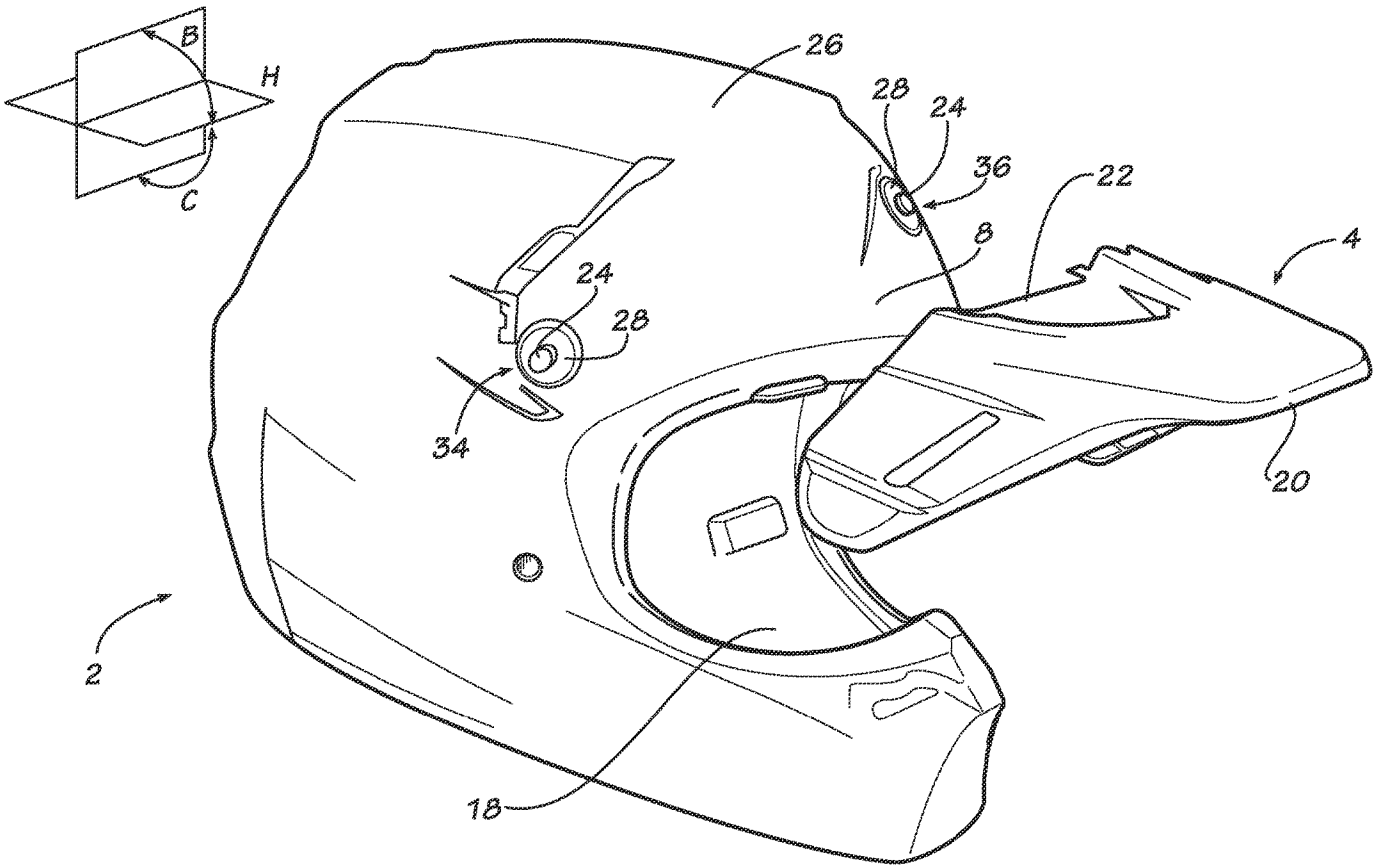
FIG. 3 is a partial perspective side view of a motocross helmet and visor as it is detached of the helmet.

Visor 4 has a broad surface that extends laterally across helmet 2. It also extends forward from helmet 2 in a direction that is generally parallel to a horizontal plane, e.g., the ground when in use or top of a user's head. In some embodiments, the visor may pivot around the sides of the helmet at an angle relative to a horizontal plane and the angle may range, for example, anywhere between −90 degrees to +270 degrees relative to a horizontal plane of the helmet. In further embodiments, the visor may be adjustable within a limited range along the upper front side of the helmet, for example, at an angle ranging between −45 and +45 degrees relative to a horizontal plane. FIG. 3 shows how a visor may be repositioned from a generally horizontal position indicated by plane H. For example, the visor may be repositioned downward in an area indicated by arrow C, or upward in an area indicated by arrow B.

Figure 2A:
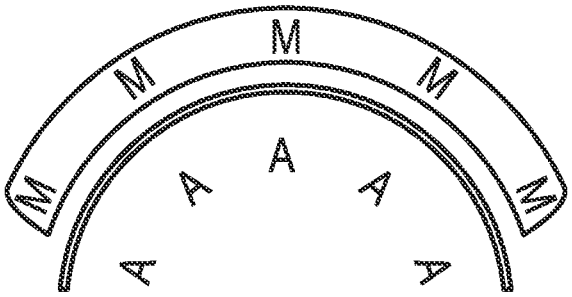
FIGS. 2A-C are schematic representations of three possible arrangements of magnetic elements and complementary elements for different attachment systems.
Figure 2B:
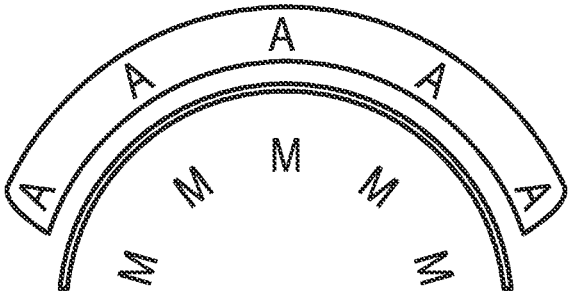
Figure 2C:
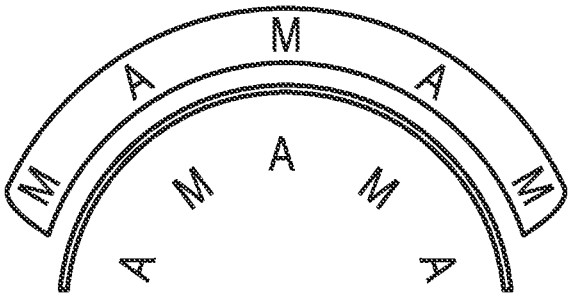

The attachment system magnetically and detachably connects the visor to the helmet via magnetic elements positioned on the shell and complementary elements located on the visor, or vice versa. The elements may be arranged along various locations on the helmet/visor contact area. In some embodiments, these elements may be arranged in an alternating pattern of permanent magnets and metal inserts on the shell and on the visor, for example as illustrated in FIGS. 2A-2C. In these figures, the letter "M" refers to a magnetic element and the letter "A" refers to a complementary element, such as a metal insert or a magnet with oppositely oriented poles to a magnet "M." For example, FIG. 2A shows a schematic view of an embodiments wherein five magnetic elements M are positioned on a visor and five complementary elements A are positioned on the helmet. FIG. 2B shows an embodiment wherein five magnetic elements M are located on the helmet and five complementary elements A are located at corresponding locations on the visor. FIG. 2C shows an arrangement of five elements in alternating configurations.

In other embodiments, the attachment system may include a single strip of magnetic material with complementary interacting elements mounted along the visor/helmet contact area. For example, the visor shown in FIG. 2A could have a single continuous magnetic strip for the area marked with the magnetic elements M.

In further embodiments, the visor may be attached to the shell at various locations along the visor/shell contact area and by any number of contact points of magnetic elements.

In the embodiments shown in FIGS. 3, 5-8 magnetic elements 24 are shown as circular protrusions of helmet shell 26 that are housed in raised portions 28 of helmet shell 26. In other embodiments, magnetic elements 24 may protrude directly from an outer shell surface 26 without raised portions or they may be inserted or integrated partially or wholly in the outer shell. In some embodiment the magnetic elements may be coated with a protective layer such as a plastic or a rubber film or sheet material.

FIGS. 4, 9-12 show visor 4 having complementary elements 30 integrated with inner surface 6 of visor 4. For example, the visor may have complementary ferromagnetic elements, such as metal inserts. Complementary elements 30 may be shaped and dimensioned to complement magnetic elements 24 and are positioned on visor 4 at locations corresponding to magnetic elements 24 on helmet shell 26.

In the embodiment shown, outer shell 26 and inner surface 6 of visor 4 have complementary shapes to keep the visor in place. The attachment system effectively couples visor 4 to helmet 2 based on the complementary contoured shapes of helmet 2 and visor 4 and the magnetic force of magnetic elements 24 and complementary elements 30. In contrast to the existing systems, there is no need for additional coupling features that would require openings in the outer shell of the helmet or that would interfere with aerodynamic features.

FIGS. 3-12 show helmet 2 and visor 4 having three contact points along shell 26 of helmet 2. Two contact points 34 and 38 are located along the right and left sides of the helmet respectively, at locations generally opposite from each other. One contact point 36 is located in a central area of visor 4. FIG. 3 shows an outer shell 26 of a motocross helmet 2 with two of the three magnetic contact points on the helmet shown. At the right side of helmet 2, a contact point 34 at a location corresponding approximately to the right temple on the head of a wearer. A second contact point 36 is shown protruding from a central upper area 14 of helmet 2. A third contact point 38 is located at the left side of the helmet at a location that is the minor view of contact point 34 shown at the right side of the helmet.

Figure 4:
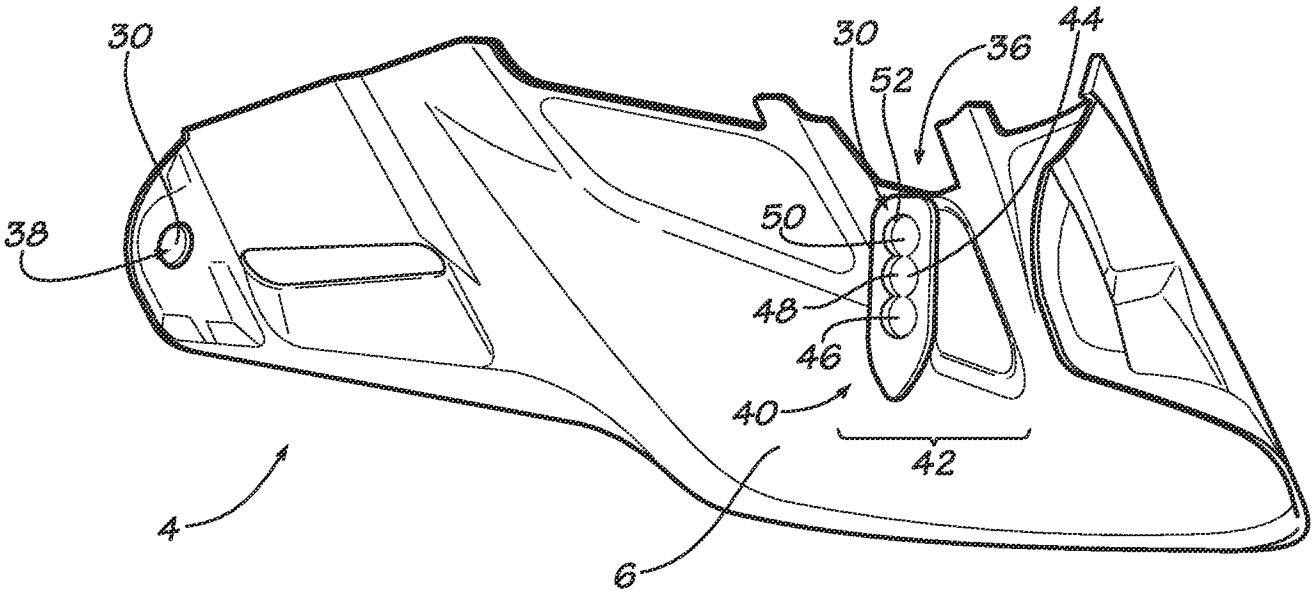
FIG. 4 is a perspective view from the back side of a visor similar to the one shown in FIG. 3 and showing part of a vertical adjustment mechanism for the visor.
Figure 5:
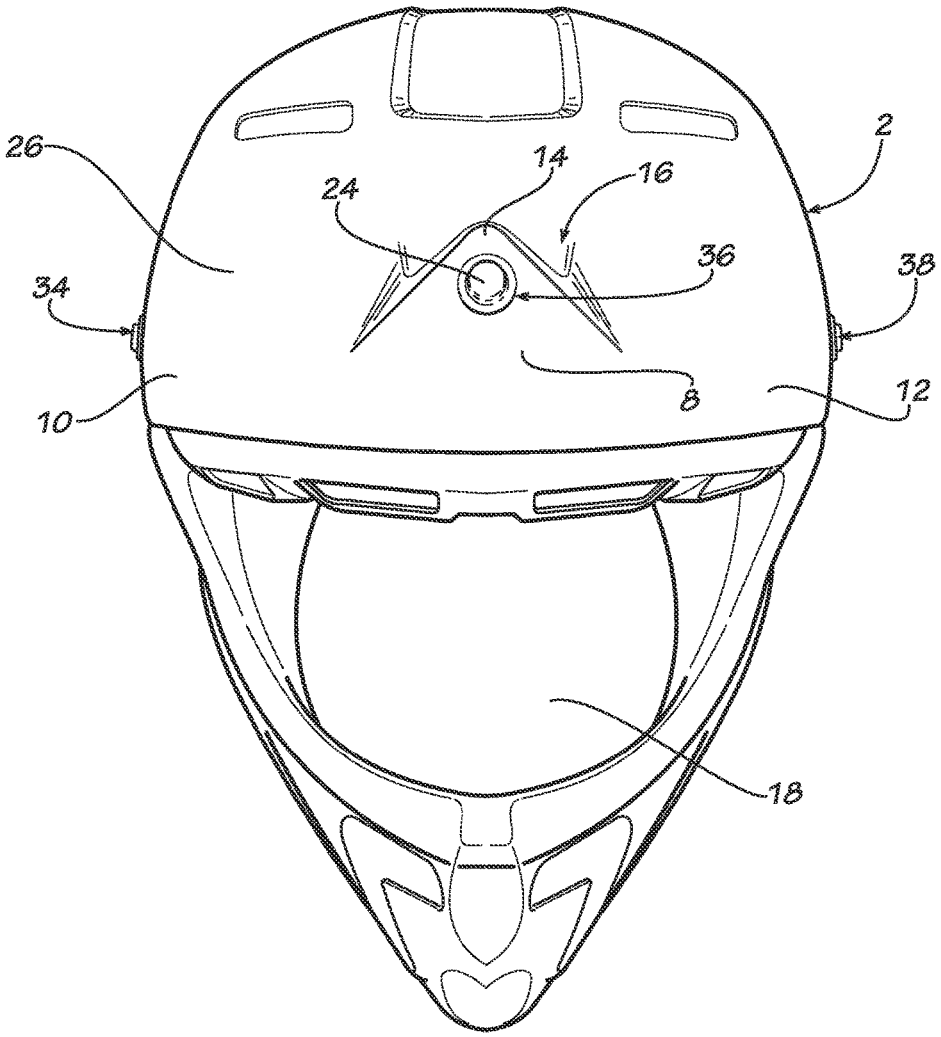
FIG. 5 shows a front view of another embodiment of a motocross helmet without a visor attached.
Figure 6:
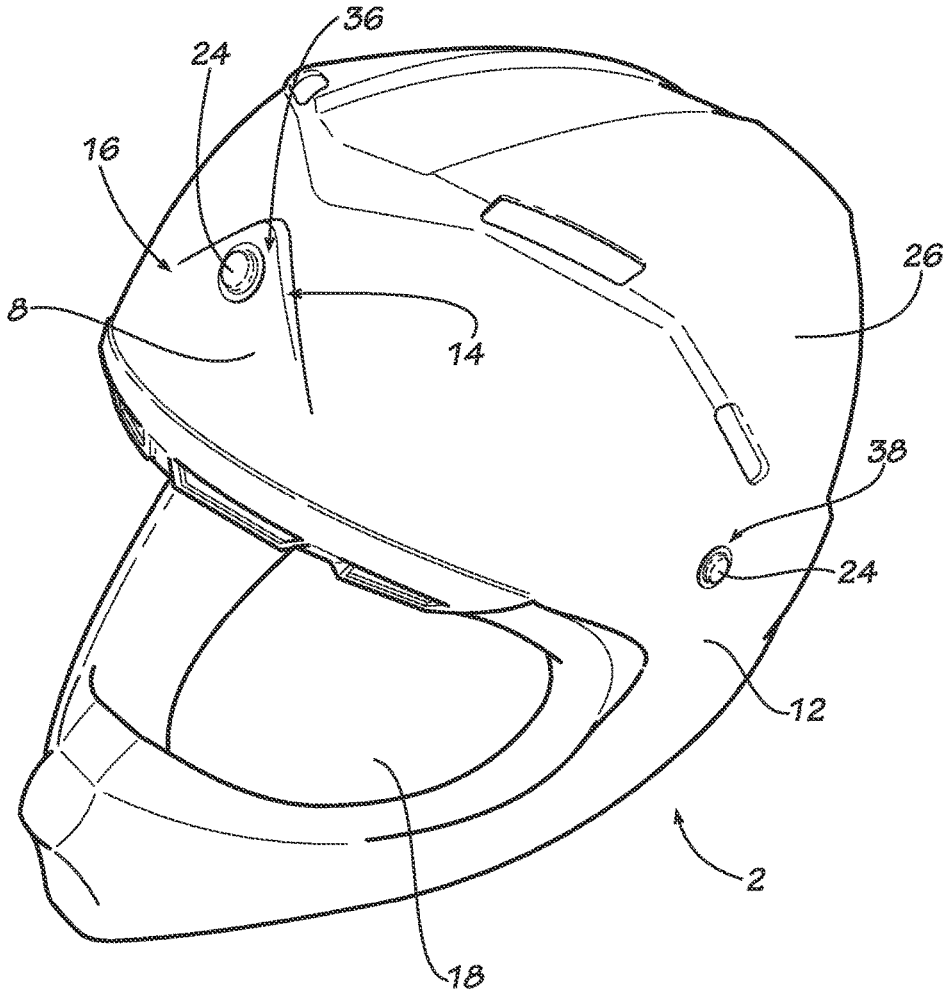
FIG. 6 shows a perspective view of the motocross helmet of FIG. 5.
Figure 7:
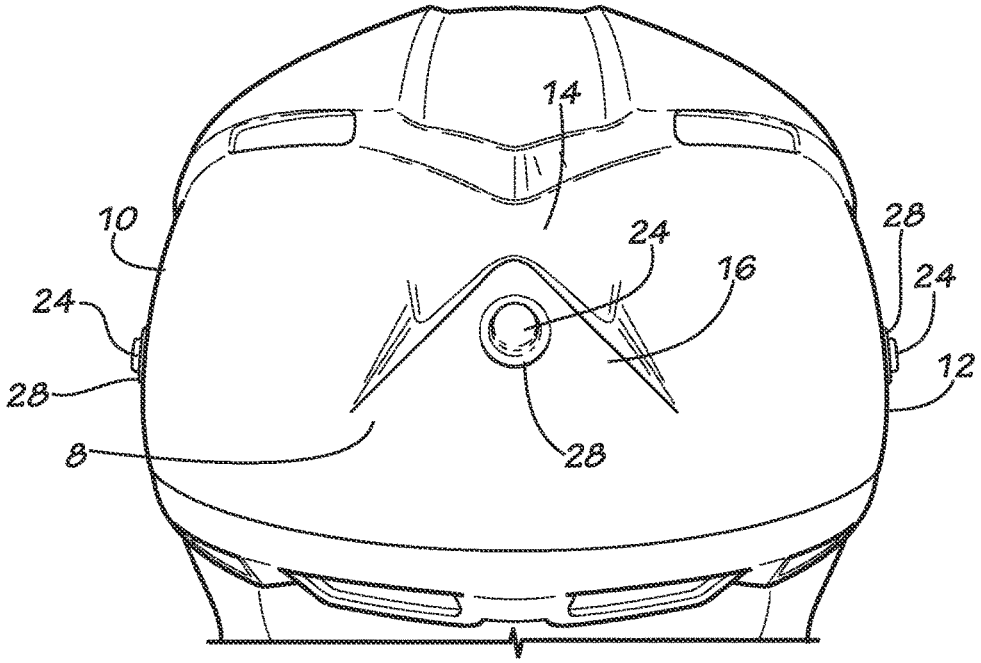
FIG. 7 shows a detail of a magnetic element at the front of the helmet of FIG. 5.
Figure 8:
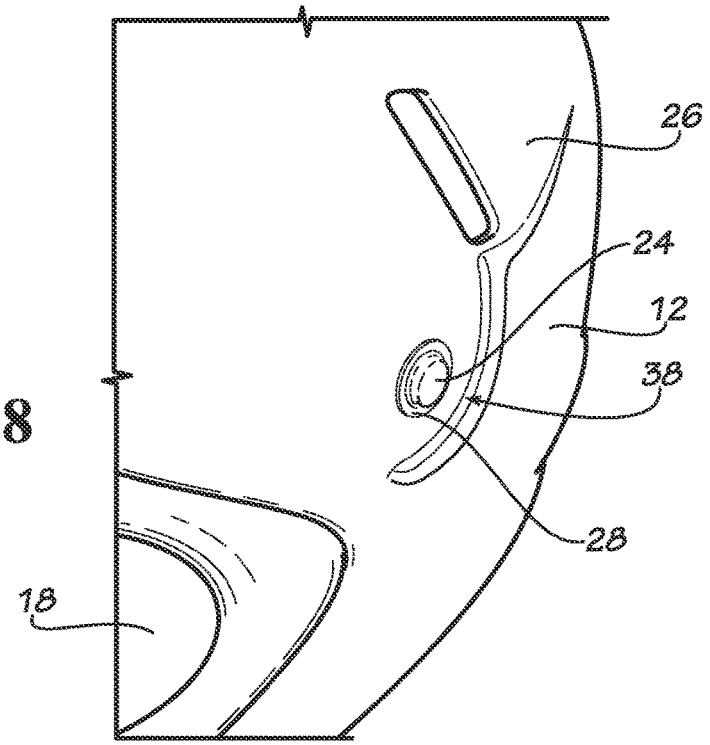
FIG. 8 shows a detail of a magnetic element at the left side of the helmet of FIG. 5.
Figure 9:
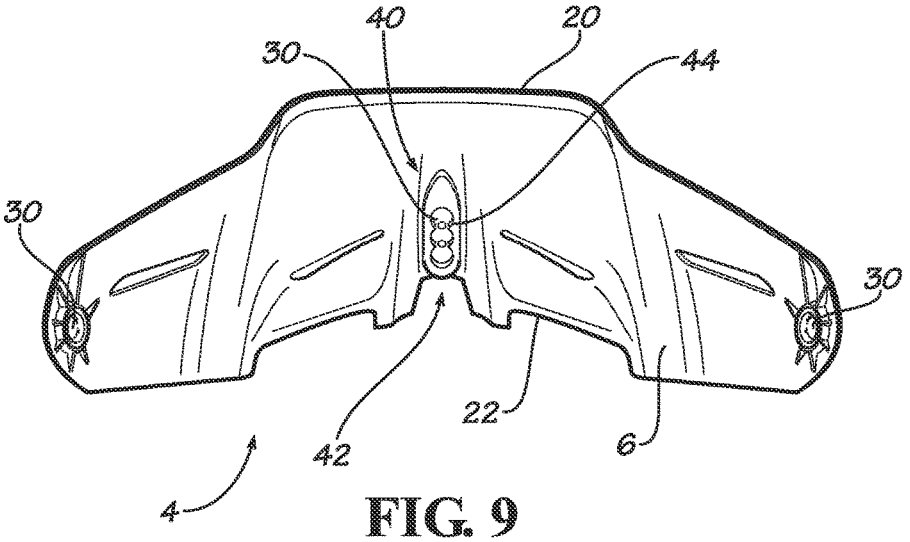
FIG. 9 shows a back view of a visor for the helmet of FIG. 5.
Figure 10:
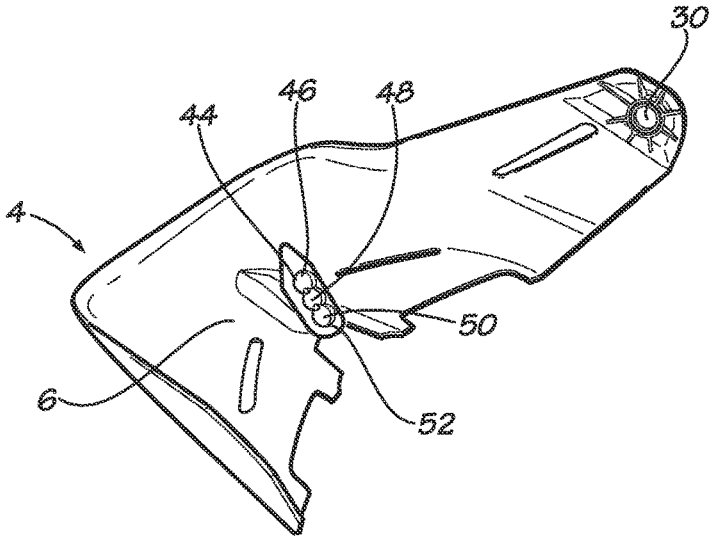
FIG. 10 shows a perspective view of the visor of FIG. 9.
Figure 11:
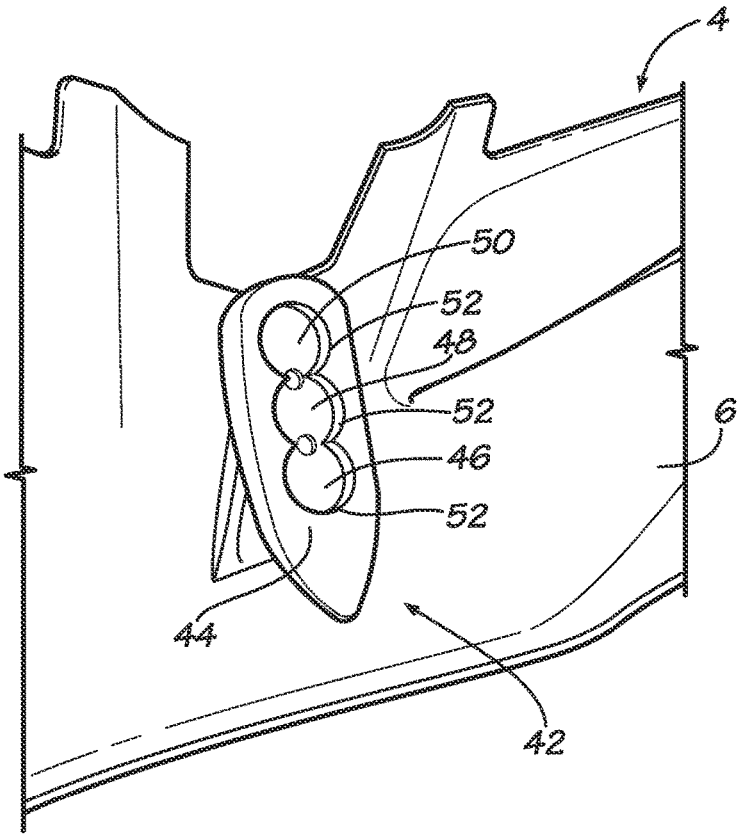
FIG. 11 shows a detail of the adjustment mechanism on the visor of FIG. 9.
Figure 12:
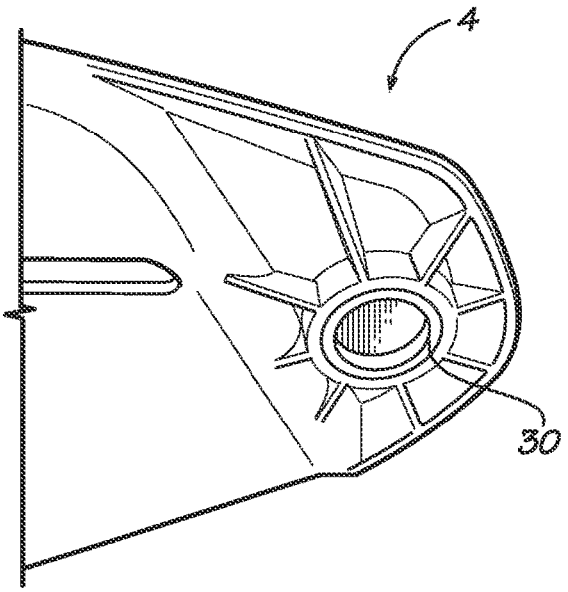
FIG. 12 shows a detail of complementary element on the visor of FIG. 9.

FIG. 4 shows visor 4 as it is detached from helmet 2. Inner surface 6 of visor 4 is contoured to complement a portion of outer shell 26 at upper front surface 8. A first complementary element 30 that couples to a magnetic element on the left side of the helmet is shown. A second complementary element (not shown) is located at the right side of the visor, which is the minor image of the first complementary element.

The attachment system may include any type of magnetic fasteners. The fasteners may include first and second parts containing surfaces of magnetic material. For example, the first part may contain a magnetic material that may be attracted to a permanent magnet in the second part. The magnets and metal inserts may have a button shape, as shown, or an annular shape, or any other shape. The materials used in the attachment system are materials or objects that produce a magnetic field. This magnetic field creates a force that pulls on other ferromagnetic materials like iron and attracts or repels other magnets. The materials may be permanent magnet or materials that can be magnetized, such as ferromagnetic materials. Examples include iron, nickel, cobalt, some alloys of rare earth metals such as neodymium magnets and samarium-cobalt magnets, and some naturally occurring minerals such as lodestone. The elements used in the attachment system are selected based on the overall strength of a magnet. Other examples of magnetic elements that may be used are ceramic magnets and alnico magnets. In some embodiments, injection molded magnets may be used. These magnets are a composite of various types of resin and magnetic powders, allowing parts of complex shapes to be manufactured by injection molding. The physical and magnetic properties of the product depend on the raw materials, but are generally lower in magnetic strength and resemble plastics in their physical properties. In some embodiments, flexible magnets may be used, using a flexible resin or binder such as vinyl, and produced in flat strips, shapes or sheets. These magnets are lower in magnetic strength but can be very flexible, depending on the binder used.

The complementary elements may include a magnetically attractive material, such as a metal. Suitable materials include iron, nickel, cobalt, steel, stainless steel, or any other suitable metal or metal alloy.

The magnetic elements and complementary elements are selected to allow the visor to be firmly fixed in place during ordinary use of the helmet. Ordinary use refers to any use of the helmet that is ordinary or common use for the sport or applications in which the helmet is used. For example, a motocross helmet's ordinary use includes use of the helmet associated with driving the motorcycle and withstanding shocks and vibrations. Upon impact with a surface, for example during a crash and contact of the visor with a ground surface or an obstacle, a strong force causes the contact elements to release and allow the visor to break away from the helmet. Impact severity requirements vary widely across helmet types and even across standards prepared for the same helmet type.

Optionally, the attachment system may include an adjustment mechanism allowing for vertical adjustment of the visor along the helmet, for example to allow a rider to adjust the visor according to the sun conditions. The adjustment mechanism allows for incremental adjustments of the visor relative to the helmet. In some embodiments, the adjustment mechanism may be integrated with magnetic elements of the attachment system.

FIGS. 4, 9-12 show examples of adjustment mechanism 40 positioned generally along a midline of the visor at a central location 42. The adjustment mechanism includes a strip or panel of complementary elements 44 mounted on inner surface 6 of visor 4. Complementary elements 44 have three indents or slots 46, 48, 50 with contoured ridges 52 that interact with magnetic elements 24 on the outer shell 26. Ridges 52 allow a forward/backward adjustment of visor 4 relative to shell 2. When a user adjusts the position of the visor on the helmet, the user grabs the forward extending part of the visor and pulls it forward or pushes it backward on the helmet. The visor then pivots around the outer two contact points along the sides of the helmet and the visor is adjusted vertically by connecting one of the ridges with the complementary magnetic element on the shell so that the magnetic element interlocks with the corresponding opening in the complementary element and the visor is held in the desired location. In some embodiments, the complementary element may be formed of a machined metal with slots that capture the magnetic element.

Another example of an adjustment mechanism is shown in FIG. 1. A perspective back view of adjustment mechanism 60 is shown with the visor attached to the helmet. The visor may be coupled to the helmet and pivot along the sides of the helmet, for example as described above, and the adjustment mechanism allows for repositioning of the visor in an upward or downward direction by pivoting along left and right contact points. The adjustment mechanism 60 may include complementary elements 60A, 60B, and 60C at locations facing the helmet so that the complementary elements engage a magnetic element in a central location on the helmet. The magnetic elements and complementary elements may be shaped similarly to the elements described in the embodiments above. FIG. 1 shows visor 4 coupled to helmet 2 with visor 4 angled upward relative to a horizontal plane. Visor 4 may be held in this position, for example, by complementary element 60C interacting with a magnetic element on the helmet.

In other embodiments, the adjustment mechanism could be a mechanism separate from the magnetic attachment system, for example, conventional mechanical fasteners that hold the visor in position in a releasable engagement that does not interfere with release of the visor upon impact, or a quick release system of plastic interlocking elements. Other embodiments may have an adjustment mechanism that is slideably adjustable. In further embodiments, the adjustment mechanism may comprise a plurality of spaced apart magnetic elements along a vertical line.

The inventive subject matter allows for a visor to break away of the helmet in a manner that is safer than that of prior art systems because the visor detaches on impact and does not dig into the ground, as prior art visors would. Additionally, the helmet maintains a sleek, aerodynamic finish as the visor attaches without the use of exterior clips or fixtures. It also may allow for adjustability or replacement of the visor.

The inventive subject matter is further directed to a method for making an attachment system and protective headgear by forming an outer shell and a visor. The inner surface of the visor is shaped to complement a portion of the outer shell which may be a molded material or a composite construction. An attachment system is formed by mounting magnetic elements on the outer shell and complementary elements on the inner surface of the visor at corresponding locations. The magnetic elements are selected based on magnetic properties that are adapted to magnetically attract the complementary elements and that hold the visor in the desired position on the outer shell. The magnetic strength and contoured shapes of visor and helmet hold the visor in place during ordinary use of the headgear, and allow the visor to be released from the headgear upon impact of the visor with a rigid surface.

Persons skilled in the art will recognize that many modifications and variations are possible in the details, materials, and arrangements of the parts and actions which have been described and illustrated in order to explain the nature of the inventive subject matter, and that such modifications and variations do not depart from the spirit and scope of the teachings and claims contained therein.

All patent and non-patent literature cited herein is hereby incorporated by references in its entirety for all purposes.

The invention claimed is:

1. Protective headgear comprising:

an outer shell;

a visor having a leading edge, a trailing edge, and an inner surface extending from the trailing edge to the leading edge defining an extension direction, wherein the trailing edge and the inner surface are shaped to complement a portion of the outer shell;

an attachment system for detachably coupling the visor to the outer shell and comprising one or more magnetic elements disposed on the outer shell and a plurality of complementary elements disposed on the inner surface of the visor in a linear arrangement such that the plurality of complementary elements extend linearly along the inner surface in the extension direction, the plurality of complementary elements positioned to correspond to the location of at least one of the one or more magnetic elements, wherein a first total number of the plurality of complementary elements extending along the inner surface of the visor is greater than a second total number of the one or more magnetic elements disposed on the outer shell; and wherein the magnetic properties of the one or more magnetic elements are adapted to magnetically attract the complementary elements and hold the visor in each of a plurality of desired positions relative to the outer shell, keep the visor in place during ordinary use of the headgear, and release the visor from the outer shell upon an impact load applied to the visor.

2. The protective headgear of claim 1, wherein each of at least two magnetic elements are mounted at generally opposite sides of the outer shell and, wherein each of at least two complementary elements are mounted at corresponding locations on the visor.

3. The protective headgear of claim 1, wherein at least one of the one or more magnetic elements is mounted at an upper area along a midline of the outer shell and the plurality of complementary elements of the visor are substantially tangent to an outer surface of the outer shell.

4. The protective headgear of claim 1, wherein the visor extends from the outer shell in a plane that is generally parallel to a horizontal plane of the outer shell.

5. The protective headgear of claim 1, wherein the visor is arranged to pivot about an axis extending through the sides of the outer shell to orient the visor at a selected angle relative to a horizontal plane.

6. The protective headgear of claim 1, further comprising an adjustment mechanism having one or more ridges positioned between adjacent complementary elements of the visor that are shaped to complement the one or more magnetic elements.

7. The protective headgear of claim 6, wherein the adjustment mechanism allows for incremental adjustments of the visor in a vertical direction.

8. The protective headgear of claim 6, wherein the one or more ridges are contoured to interact with the one or more magnetic elements and allow repositioning and holding the visor in a vertical direction.

9. A headgear, comprising:

an outer shell including one or more first coupling elements positioned along the outer shell;

a frontal extension having an inner surface shaped to complement one or more portions of the outer shell, the frontal extension including one or more second coupling elements positioned along the inner surface to correspond with the one or more first coupling elements to couple the frontal extension to the outer shell, wherein a first total number of the second coupling elements positioned along the inner surface of the frontal extension is greater than a second total number of the one or more first coupling elements positioned along the outer shell;

wherein each of the one or more first coupling elements includes a protrusion and each of the one or more second coupling element defines a recess configured to receive a respective protrusion of the one or more first coupling elements; and wherein the one or more first coupling elements and the one or more second coupling elements are configured to cooperatively at least one of (i) couple the frontal extension to the outer shell with a break away connection and (ii) facilitate toolless pivotable adjustment of an angle at which the frontal extension extends from the outer shell.

10. The headgear of claim 9, wherein each of the one or more first coupling elements is disposed on a respective portion of the outer shell having a continuous surface.

11. The headgear of claim 10, wherein the continuous surface has a convex shape.

12. The headgear of claim 9, wherein the one or more first coupling elements and the one or more second coupling elements are configured to couple the frontal extension to the outer shell with the break away connection such that the frontal extension is effectively secured to the outer shell during ordinary use of the headgear, while allowing release of the frontal extension from the outer shell in response to an impact to the frontal extension.

13. The headgear of claim 9, wherein the one or more first coupling elements and the one or more second coupling elements are configured to facilitate the toolless pivotable adjustment of the angle at which the frontal extension extends from the outer shell in response to a user pulling forward or pushing backward on the frontal extension.

14. The headgear of claim 9, wherein one of (i) the one or more first coupling elements and (ii) the one or more second coupling elements include an indexing element, wherein the indexing element is configured to facilitate incremental pivotable repositioning of the frontal extension and assist in holding the frontal extension at a selected angle.

15. The headgear of claim 14, wherein the indexing element has one or more ridges that are contoured to complement a coupling element of the other one of (i) the one or more first coupling elements and (ii) the one or more second coupling elements.

16. The headgear of claim 9, wherein the one or more first coupling elements and the one or more second coupling elements include at least one of magnetic elements and complementary elements, wherein the magnetic elements comprise a permanent magnet material and the complementary elements comprise a ferrous material.

17. The headgear of claim 9, wherein the one or more second coupling elements of the frontal extension cover the one or more first coupling elements of the outer shell and the one or more second coupling elements are positioned along the inner surface of the frontal extension such that the frontal extension and the outer shell appear to be a unitary structure when coupled.

18. A headgear, comprising:

an outer shell including one or more first coupling elements positioned along the outer shell;

an extension having an inner surface shaped to complement one or more portions of the outer shell, the extension including one or more second coupling elements positioned along the inner surface to correspond with the one or more first coupling elements to couple the extension to the outer shell, wherein a first total number of the second coupling elements positioned along the inner surface of the extension is greater than a second total number of the one or more first coupling elements positioned along the outer shell;

wherein one of (i) each of the one or more first coupling elements and (ii) each of the one or more second coupling elements includes a protrusion, and the other of (i) each of the one or more first coupling elements and (ii) each of the one or more second coupling elements defines a recess configured to receive a respective protrusion; and wherein the one or more first coupling elements and the one or more second coupling elements are configured to cooperatively at least one of (i) couple the extension to the outer shell with a break away connection and (ii) facilitate toolless relocation of the extension in relation to the outer shell.

19. The headgear of claim 18, wherein the extension is disposed on a front surface of the outer shell.

* * * * *